US012674334B2

(12) United States Patent
Verst et al.

(10) Patent No.: US 12,674,334 B2
(45) Date of Patent: Jul. 7, 2026

(54) CONCRETE FORM APPARATUS AND METHOD OF USING

(71) Applicant: American Forming Products LLC, Corona, CA (US)

(72) Inventors: Brett Verst, Santa Ana, CA (US); Elden Peterson, Corona, CA (US)

(73) Assignee: American Forming Products LLC, Corona, CA (US)

( * ) Notice: Subject to any disclaimer, the term of this patent is extended or adjusted under 35 U.S.C. 154(b) by 52 days.

(21) Appl. No.: 18/303,553

(22) Filed: Apr. 19, 2023

(65) Prior Publication Data

US 2023/0250652 A1 Aug. 10, 2023

Related U.S. Application Data

(63) Continuation of application No. 16/725,831, filed on Dec. 23, 2019, now Pat. No. 11,649,649.
(Continued)

(51) Int. Cl.
*E04G 9/02* (2006.01)
*E04G 9/10* (2006.01)
(Continued)

(52) U.S. Cl.
CPC ..... *E04G 9/021* (2013.01); *E04G 9/10* (2013.01); *E04G 17/001* (2013.01); *E04G 17/02* (2013.01)

(58) Field of Classification Search
CPC . E04G 9/021; E04G 17/001; E04G 2017/008; E04G 17/02
See application file for complete search history.

(56) References Cited

U.S. PATENT DOCUMENTS 1,892,311 A 12/1932 Simpson et al.
2,157,688 A 5/1939 Cascio
(Continued)

FOREIGN PATENT DOCUMENTS

CA 3040508 A1 11/2019
CH 678551 A5 9/1991
(Continued)

OTHER PUBLICATIONS

Translation of FR-2198042-A1 (Year: 1974).*
Translation of FR-2991704-A1 (Year: 2013).*

*Primary Examiner* — John J DeRusso
(74) *Attorney, Agent, or Firm* — Dickinson Wright PLLC

(57) ABSTRACT

A concrete form apparatus includes a first component of a cardboard material and a second component of a core material. The first component is rectangular in shape and includes at least three perforations along a lengthwise dimension of the cardboard material. The second component is sized to fit within an internal cavity that is formed when the cardboard material is folded along the at least three perforations. The second component is placed onto the first component, and the first component is folded along the perforations to encapsulate the second component within the internal cavity to provide the concrete form apparatus. The first portion includes an inner surface facing the internal cavity, and the inner surface defines at least one extension inlet that is configured to receive and engage a corresponding extension outlet of a coupling apparatus for connecting the concrete form apparatus to another concrete form apparatus.

20 Claims, 11 Drawing Sheets

Related U.S. Application Data

(60) Provisional application No. 62/791,560, filed on Jan. 11, 2019.

(51) Int. Cl.
*E04G 17/00* (2006.01)
*E04G 17/02* (2006.01)

(56) References Cited

U.S. PATENT DOCUMENTS

| | | | |
|---|---|---|---|
| 2,991,533 | A | 7/1961 | Reid et al. |
| 3,024,512 | A | 3/1962 | Dyer |
| 3,024,513 | A | 3/1962 | Shuxteau |
| 3,381,929 | A | 5/1968 | Bancker |
| 3,798,852 | A | 3/1974 | Nicoll, Jr. |
| 3,883,999 | A | 5/1975 | Nicoll, Jr. |
| 4,023,766 | A | 5/1977 | Lubov |
| 4,685,267 | A | 8/1987 | Workman |
| 5,169,585 | A | 12/1992 | Le Gourrierec |
| 5,782,049 | A | 7/1998 | Gates et al. |
| 5,799,455 | A | 9/1998 | Gates et al. |
| 6,050,043 | A | 4/2000 | Rosenblat et al. |
| 6,332,537 | B1 | 12/2001 | Usui et al. |
| 7,243,898 | B2 | 7/2007 | McLean |
| 7,353,641 | B2 | 4/2008 | Yoshii et al. |
| 9,797,147 | B2 | 10/2017 | Turner |
| 2002/0145099 | A1 | 10/2002 | Hoyle et al. |
| 2017/0009468 | A1 | 1/2017 | Turner |
| 2020/0224438 | A1 | 7/2020 | Verst et al. |

FOREIGN PATENT DOCUMENTS

| | | | | |
|---|---|---|---|---|
| CN | 86105404 | A | 6/1987 | |
| EP | 1570967 | A2 | 9/2005 | |
| FR | 2198042 | A1 * | 3/1974 | |
| FR | 2990714 | A1 | 11/2013 | |
| FR | 2991704 | A1 * | 12/2013 | ..... E04G 9/08 |
| FR | 3077832 | B1 | 12/2020 | |
| JP | H08207930 | A | 8/1996 | |
| JP | H09503724 | A | 4/1997 | |
| JP | 2020117257 | A | 8/2020 | |
| KR | 101712137 | B1 | 3/2017 | |
| WO | 0011281 | A1 | 3/2000 | |
| WO | 2013192141 | A2 | 12/2013 | |

* cited by examiner

CONCRETE FORM APPARATUS AND METHOD OF USING

CROSS-REFERENCE TO RELATED APPLICATIONS

The present application is a continuation of U.S. patent application Ser. No. 16/725,831 entitled "CONCRETE FORM APPARATUS AND METHOD OF USING," filed Dec. 23, 2019, which claims the benefit of U.S. Provisional Application No. 62/791,560, entitled "CONCRETE FORM APPARATUS," filed Jan. 11, 2019, the content of which is incorporated herein by reference in its entirety for all purposes.

FIELD OF INVENTION

The described embodiments relate generally to concrete form apparatuses—and extension apparatus to bind them together—that can be utilized to establish a rigid perimeter within which concrete can be poured for curing.

BACKGROUND

Wooden planks—e.g., 2×4's, 2×6's, etc.—are commonly used to establish a rigid perimeter within which concrete can be poured for curing. However, there are several drawbacks to using wooden planks that have yet to be addressed. A first drawback is that the price of wood has considerably increased over the years. Another drawback is that wood is heavy, thereby making it expensive to transport. Yet another drawback is that wood is prone to warping, thereby limiting the supply of wood that can be used to reliably form straight concrete perimeters. A further drawback is that the wood usually must be discarded after the concrete is formed, which is wasteful.

Accordingly, what is needed is an improved approach for establishing a rigid perimeter within which concrete can be poured for curing.

SUMMARY

Representative embodiments described herein set forth concrete form apparatus that can be utilized to establish a rigid perimeter within which concrete can be poured for curing. According to some embodiments, the concrete form apparatus can be formed using two distinct components. The first component can be composed of a flat rigid material that is rectangular in shape and includes perforations along the lengthwise dimension of the material. In this regard, when the material is folded along the perforations, an internal cavity is formed. The second component can be composed of a material having dimensions sized in accordance with the internal cavity of the folded material. In this regard, the second component can be placed onto the first component, whereupon the first component can be folded along the perforations in the manner described above to encapsulate the second component within the internal cavity. Adhesive layers can be applied to prevent the concrete form apparatus from separating. Additionally, the exposed layers of the concrete form apparatus can be coated with a waterproofing substance to reduce the permeability of the exposed layers.

Other aspects and advantages of the invention will become apparent from the following detailed description taken in conjunction with the accompanying drawings that illustrate, by way of example, the principles of the described embodiments.

BRIEF DESCRIPTION OF THE DRAWINGS

The disclosure will be readily understood by the following detailed description in conjunction with the accompanying drawings, where like reference numerals designate like structural elements.

DETAILED DESCRIPTION

Representative applications of methods and an apparatus according to the presently described embodiments are provided in this section. These examples are being provided solely to add context and aid in the understanding of the described embodiments. It will thus be apparent to one skilled in the art that the described embodiments can be practiced without some or all of these specific details. In other instances, well-known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments can be used, and changes can be made without departing from the spirit and scope of the described embodiments.

Figure 1A:
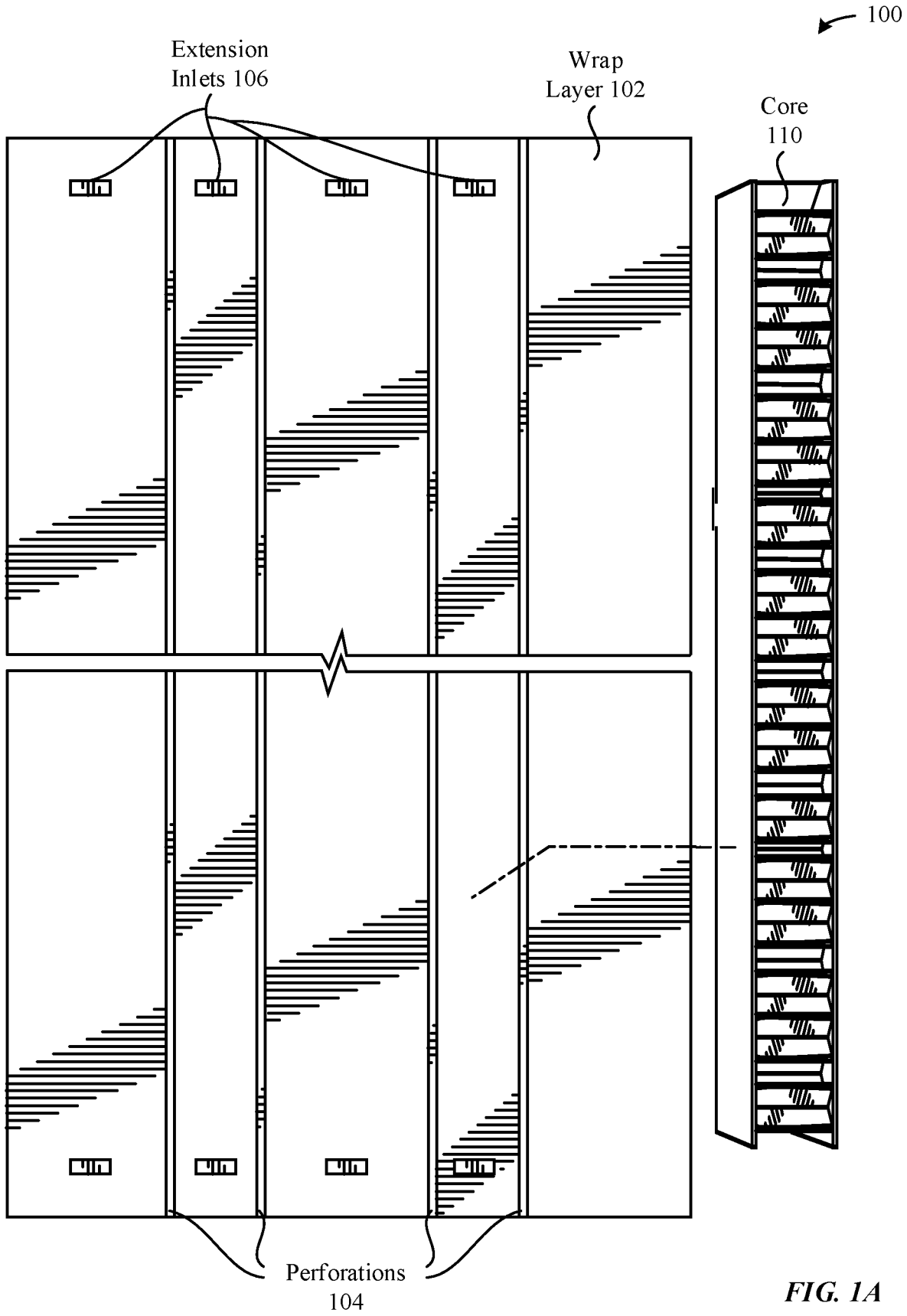
FIGS. 1A-1C illustrate conceptual diagrams of a first approach for implementing a concrete form apparatus, according to some embodiments.

FIG. 1A illustrates a conceptual diagram 100 of a first approach for implementing a concrete form apparatus, according to some embodiments. Specifically, FIG. 1A illustrates a high-level overview of two different components that can be utilized to establish the concrete form apparatus, which, as shown, can include a wrap layer 102 and a core 110. According to some embodiments, the wrap layer 102 can be composed of any material, including cardboard, paperboard, fiberboard, matboard, chipboard, and so on. It is noted that the wrap layer 102 can also be reinforced using any known approach. For example, the wrap layer 102 can incorporate any number of layers of the same (or other) materials to increase overall rigidity (e.g., single face board, single wall board, double wall board, triple wall board, and so on). The wrap layer 102 can also incorporate internal structures that increase overall rigidity, including corrugated structures (e.g., C, B, E, F, and R flute structures), honeycomb structures, and so on. It is noted that the foregoing examples do not represent an exhaustive list of the different materials and reinforcements that can be incorporated into the wrap layer 102. On the contrary, any known materials and reinforcements can be incorporated into the wrap layer 102 without departing from the scope of this disclosure.

Figure 1B:
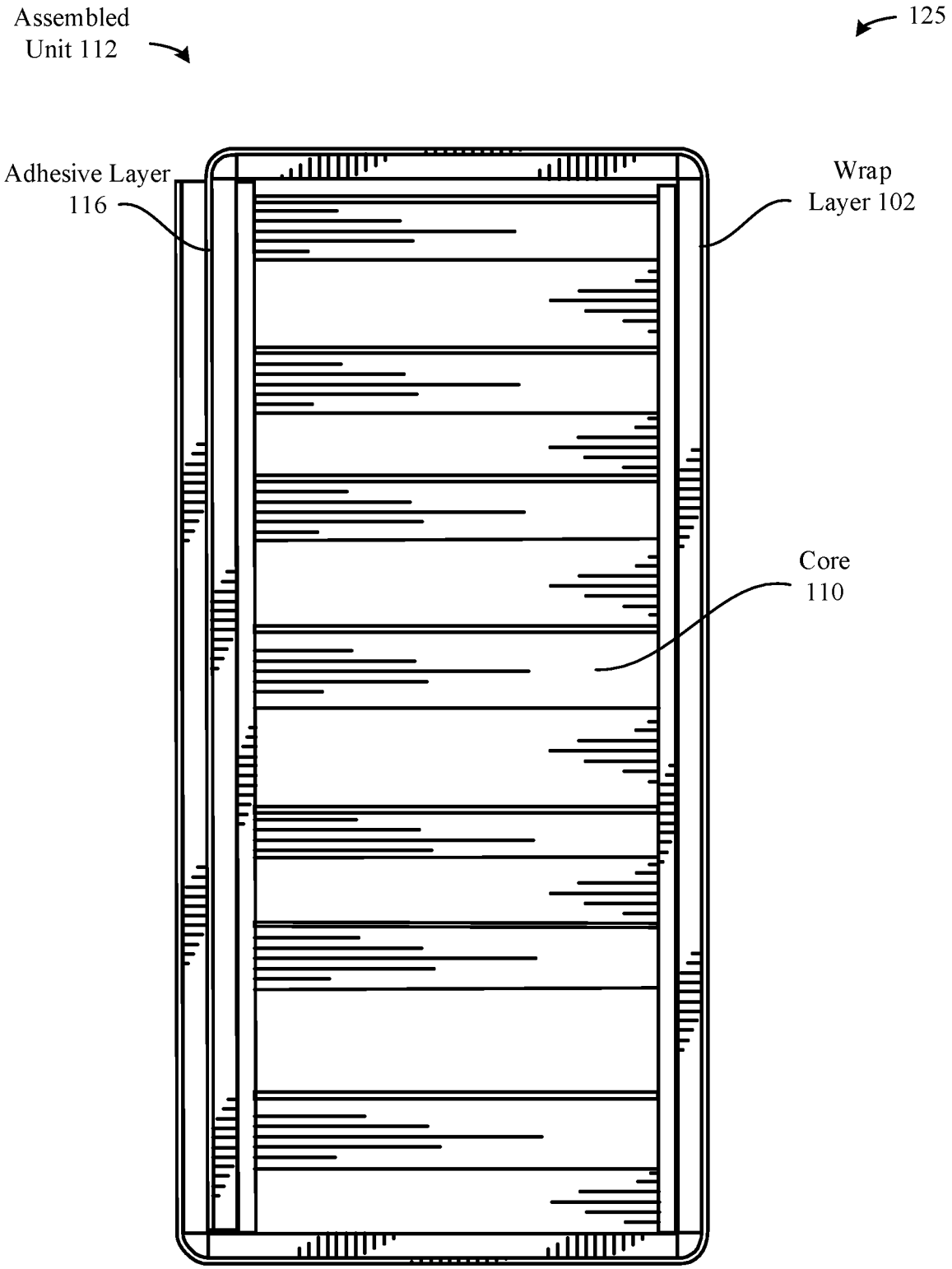
Figure 1C:
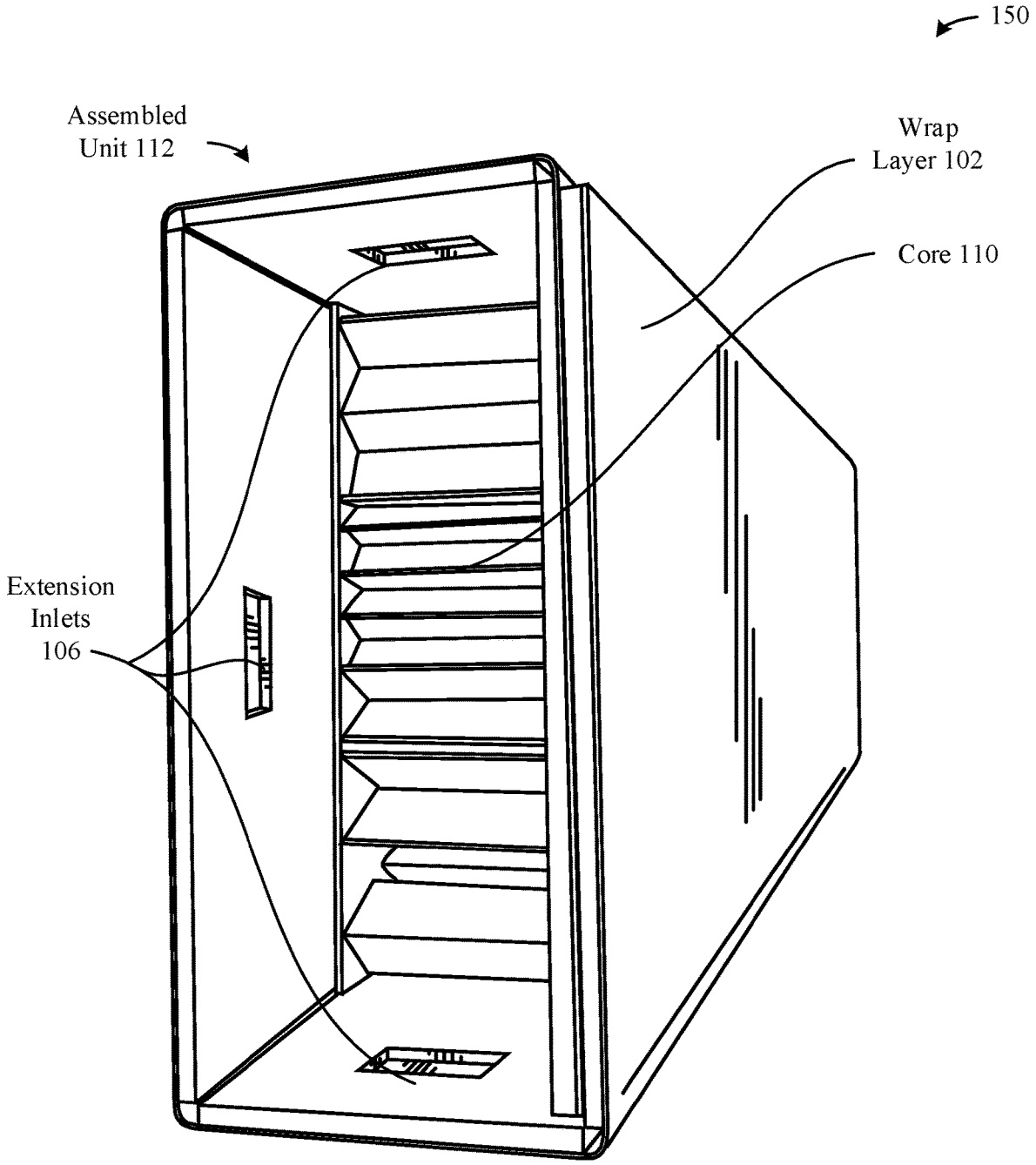

As shown in FIG. 1A, the wrap layer 102 can include perforations 104 that enable the wrap layer 102 to be folded in a manner that establishes a cavity within the wrap layer 102. It is noted that the perforations 104 can be established using any known approach. In one approach, a series of holes, slices, etc., can be introduced along a lengthwise dimension of the wrap layer 102 to enable the wrap layer 102 to be folded. For example, as shown in FIG. 1A, four perforations 104 can be established along the lengthwise dimension of the wrap layer 102 to enable the wrap layer 102 to be folded into a rectangular shape such that two of the longer edges of the wrap layer 102 overlap one another. An example of the wrap layer 102 in folded form is illustrated in FIGS. 1B-1C and described below in greater detail.

Additionally, as shown in FIG. 1A, the wrap layer 102 can include several extension inlets 106 that enable an extension apparatus to bind two or more of the concrete form apparatuses together. According to some embodiments, the extension inlets 106 can represent cavities within the wrap layer 102 that align with extension outlets on the extension apparatus when the concrete form apparatus is in a completed state, which is illustrated in FIG. 1C and described below in greater detail. It is noted, however, that such extension inlets 106 are optional and can be omitted from the wrap layer 102 for applications that do not require the utilization of extension apparatuses.

Additionally, as shown in FIG. 1A, the concrete form apparatus can include a core 110 that is sized in accordance with the wrap layer 102, the perforations 104, and the extension inlets 106. In particular, the core 110 can be sized in accordance with the cavity that is formed when the wrap layer 102 is folded along the perforations 104. In this regard, when the extension inlets 106 are not included in the wrap layer 102, the length of the core 110 can match the length of the wrap layer 102. Alternatively, when the extension inlets 106 are included in the wrap layer 102, the length of the core 110 can be shorter (relative to the length of the wrap layer 102) so that the extension inlets 106 remain internally exposed within the concrete form apparatus. This notion is illustrated in FIG. 1C, which is described below in greater detail.

According to some embodiments, the core 110 can be composed of any material, including cardboard, paperboard, fiberboard, matboard, chipboard, and so on. According to some embodiments, the core 110 can be formed by layering any of the foregoing materials together using any known technique for adhering the layers together to achieve the desired shape of the core 110. Additionally, one or more of the layers can also be reinforced using any known approach. For example, a given layer can incorporate any number of layers of the same (or other) materials to increase overall rigidity (e.g., single face board, single wall board, double wall board, triple wall board, and so on). The core 110 can also incorporate internal structures that increase overall rigidity, including corrugated structures (e.g., C, B, E, F, and R flute structures), honeycomb structures, and so on. Alternatively, the core 110 can be composed of any type of foam, either in whole or in part. It is noted that the foregoing examples do not represent an exhaustive list of the different materials and reinforcements that can be incorporated into the core 110. On the contrary, any known materials and reinforcements can be incorporated into the core 110 without departing from the scope of this disclosure.

As shown in the conceptual diagram 125 of FIG. 1B, the core 110 can be wrapped within the wrap layer 102 as it is folded along the perforations 104. Although not explicitly illustrated in FIGS. 1A-1B, it is noted that any form of adhesive can be applied to any portion of the wrap layer 102 and/or core 110 without departing from the scope of this disclosure. For example, an adhesive layer can be applied to one or more sides of the core 110, an adhesive layer can be applied to one or more of the (internal) sides of the wrap layer 102 that contact the core 110, and so on. Additionally, it is noted that an adhesive layer can be applied to one or more of the two long edges of the wrap layer 102 that overlap one another to ensure that the wrap layer 102 does not unravel. This notion is illustrated in FIG. 1B by the adhesive layer 116. In this regard, the wrap layer 102, the core 110, and the adhesive layer(s) can work together to form an assembled unit 112 that exhibits a level of rigidity that enables it to function as a concrete form.

Additionally, the conceptual diagram 150 in FIG. 1C illustrates another view of the assembled unit 112. In particular, the conceptual diagram 150 covers a scenario in which the extension inlets 106 are included in the wrap layer 102, and where the length of the core 110 is shorter (relative to the length of the wrap layer 102) so that the extension inlets 106 remain exposed within the assembled unit 112.

Figure 2A:
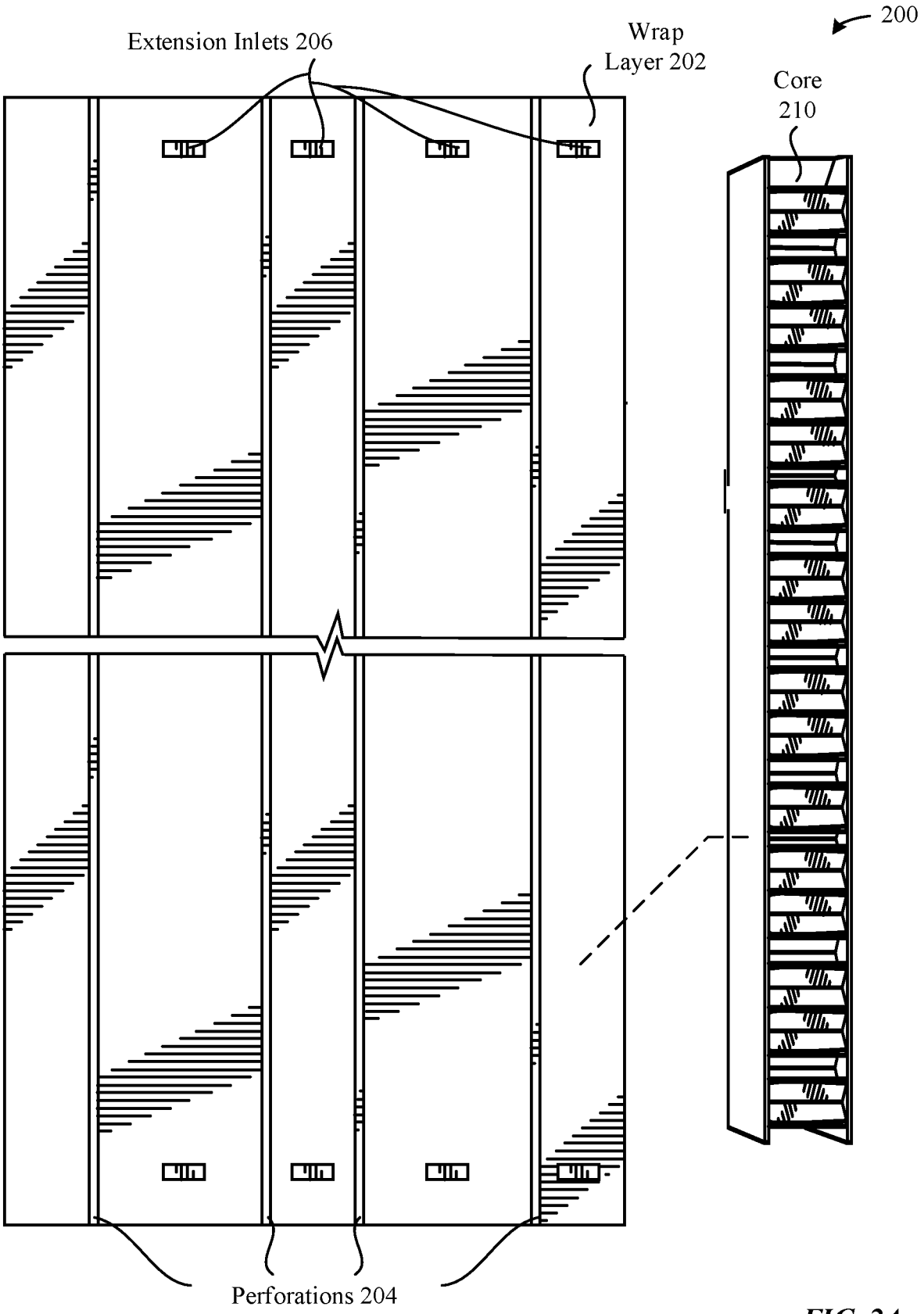
FIGS. 2A-2C illustrate conceptual diagrams of a second approach for implementing a concrete form apparatus, according to some embodiments.
Figure 2B:
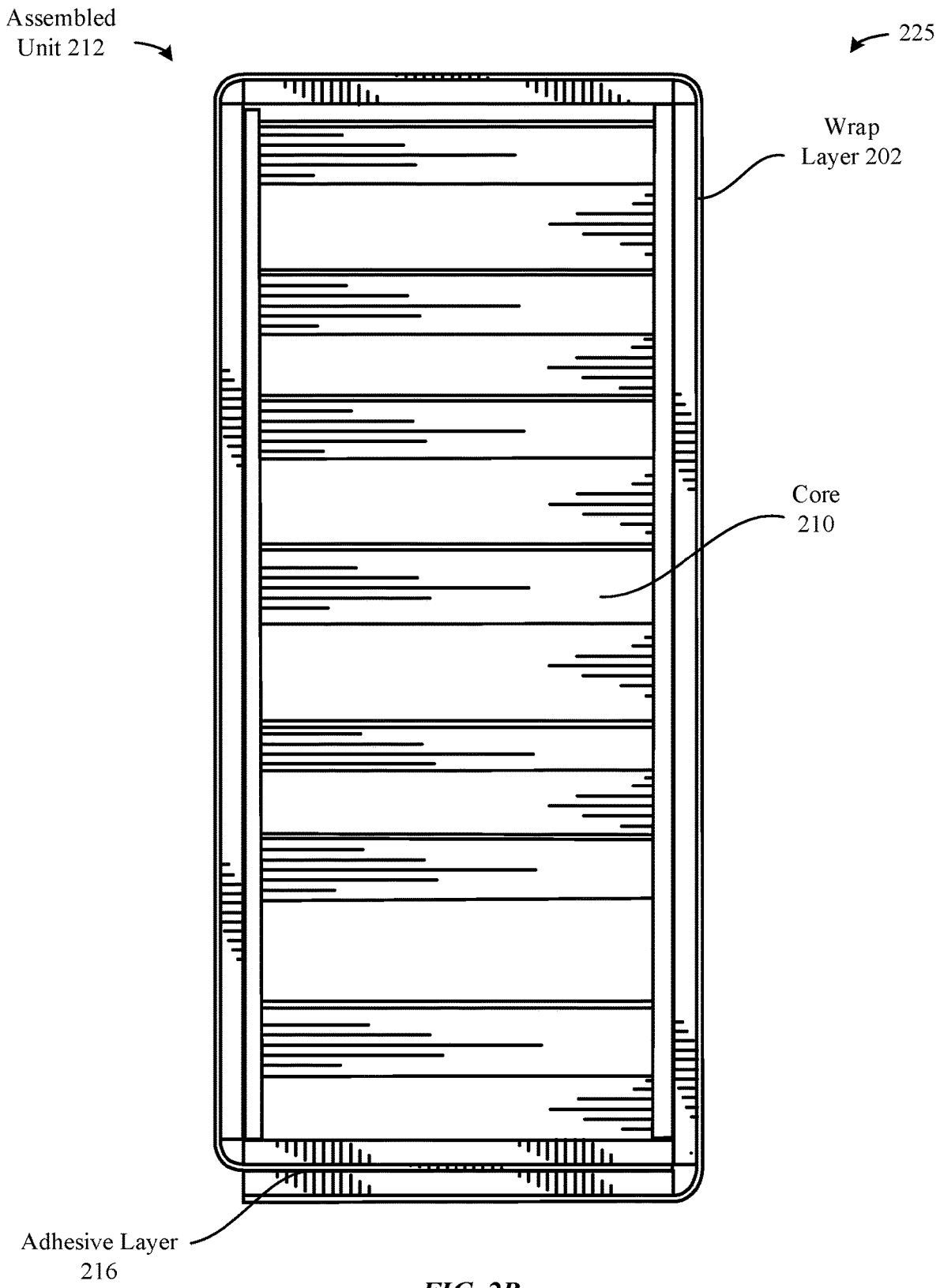
Figure 2C:
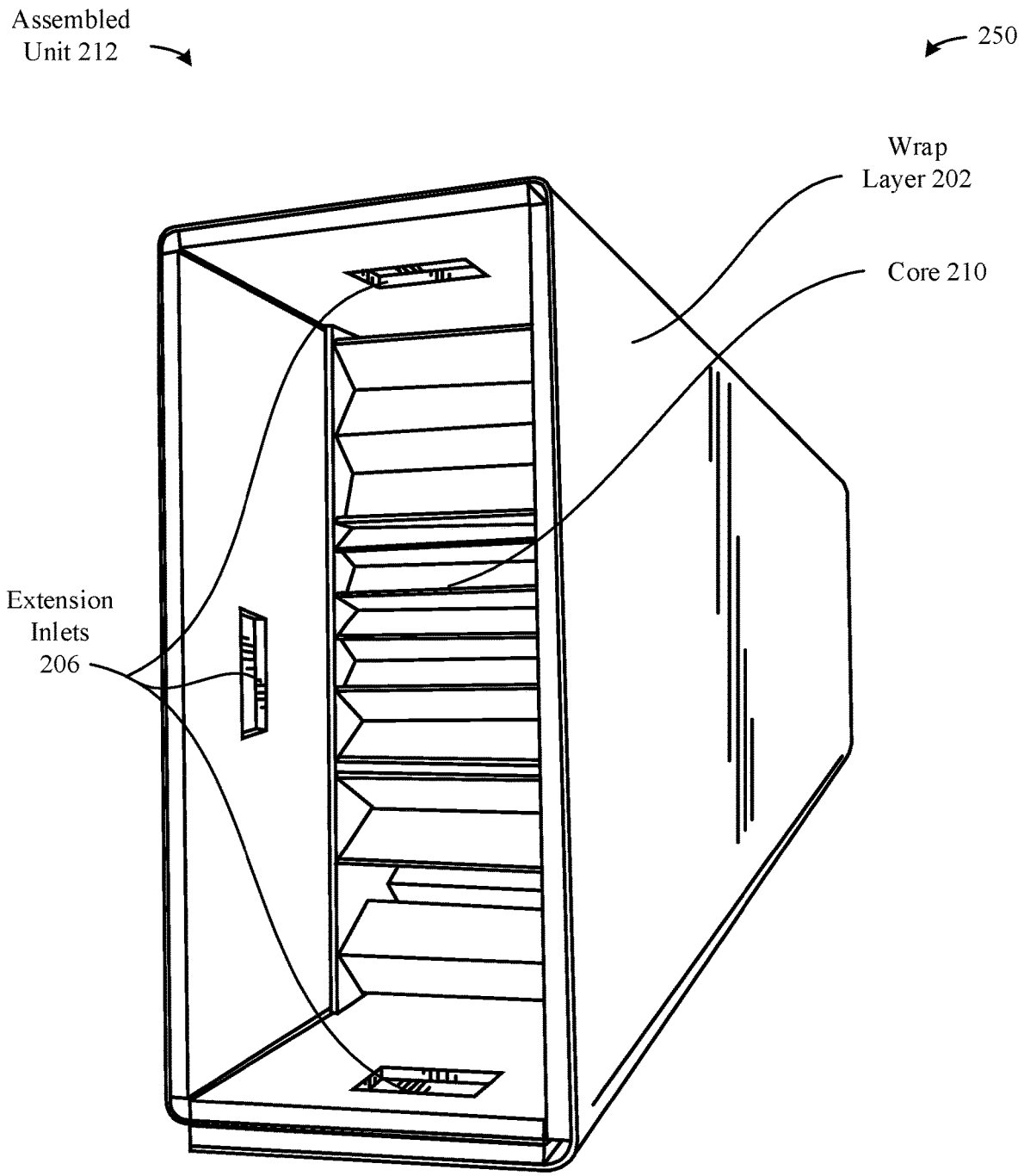

Accordingly, FIGS. 1A-1C illustrate conceptual diagrams of a first approach for implementing a concrete form apparatus, according to some embodiments. FIGS. 2A-2C—which set forth a second approach for implementing a concrete form apparatus—will now be discussed below in greater detail.

FIG. 2A illustrates a conceptual diagram 200 of a high-level overview of two different components that can be utilized to establish a concrete form apparatus, which, as shown, can include a wrap layer 202 and a core 210. According to some embodiments, the wrap layer 202 can be composed in the same manner as the wrap layer 102 of FIG. 1A. However, a notable difference is that the wrap layer 202 is shorter in width (relative to the wrap layer 102 of FIG. 1A) and includes different perforations 204 (relative to the wrap layer 102 of FIG. 1A). In this regard, when the wrap layer 202 is folded along the perforations 204, two shorter edges of the resulting rectangular shape overlap one another (as opposed to two longer edges that overlap one another when using the wrap layer 102). This notion is illustrated in FIG. 2B. One benefit of this approach is that less material is needed to manufacture the wrap layer 202, which can reduce weight and cost of material. However, since the overlapping sections are shorter in length, the overall rigidity of the concrete form apparatus is reduced, thus constituting a tradeoff between cost and strength.

Additionally, as shown in FIG. 2A, the wrap layer 202 can include several extension inlets 206 that enable an extension apparatus to bind two or more of the concrete form apparatuses together. According to some embodiments, the extension inlets 206 can represent cavities within the wrap layer 202 that align with extension outlets on the extension apparatus when the concrete form apparatus is in a completed state, which is illustrated in FIG. 2C and described below in greater detail. Again, it is noted that such extension inlets 206 are optional and can be omitted from the wrap layer 202.

Additionally, as shown in FIG. 2A, the concrete form apparatus can include a core 210 that is sized in accordance with the wrap layer 202, the perforations 204, and the extension inlets 206. The core 210 can be composed in the same manner as the core 110 of FIG. 1A. As previously described herein, the core 210 can be sized in accordance with the cavity that is formed when the wrap layer 202 is folded along the perforations 204. In this regard, when the extension inlets 206 are not included in the wrap layer 202, the length of the core 210 can match the length of the wrap layer 202. Alternatively, when the extension inlets 206 are included in the wrap layer 202, the length of the core 210 can be shorter (relative to the length of the wrap layer 202) so that the extension inlets 206 remain exposed within the concrete form apparatus. This notion is illustrated in FIG. 2C, which is described below in greater detail.

In any case, the core 210 can be placed onto the wrap layer 202—e.g., centered along the lengthwise dimension of the wrap layer 202—such that the wrap layer 202 can be folded around the core 210 to establish an assembled unit 212, which is illustrated in FIGS. 2B-2C and described below in greater detail.

As shown in the conceptual diagram 225 of FIG. 2B, the core 210 can be wrapped within the wrap layer 202 as it is folded along the perforations 204. Although not explicitly illustrated in FIGS. 2A-2B, it is noted that any form of adhesive can be applied to any portion of the wrap layer 202 and/or core 210 without departing from the scope of this disclosure. For example, an adhesive layer can be applied to one or more sides of the core 210, an adhesive layer can be applied to one or more of the (internal) sides of the wrap layer 202 that contact the core 210, and so on. Additionally, it is noted that an adhesive layer can be applied to one or more of the two shorter edges of the wrap layer 202 that overlap one another to ensure that the wrap layer 202 does not unravel. This notion is illustrated in FIG. 2B by the adhesive layer 216. In this regard, the wrap layer 202, the core 210, and the adhesive layer(s) can work together to form an assembled unit 212 that exhibits a level of rigidity that is commensurate for functioning as a concrete form.

Additionally, the conceptual diagram 250 in FIG. 2C illustrates another view of the assembled unit 212. In particular, the conceptual diagram 250 covers a scenario in which the extension inlets 206 are included in the wrap layer 202, and where the length of the core 210 is shorter (relative to the length of the wrap layer 202) so that the extension inlets 206 remain exposed within the assembled unit 212.

Figure 3A:
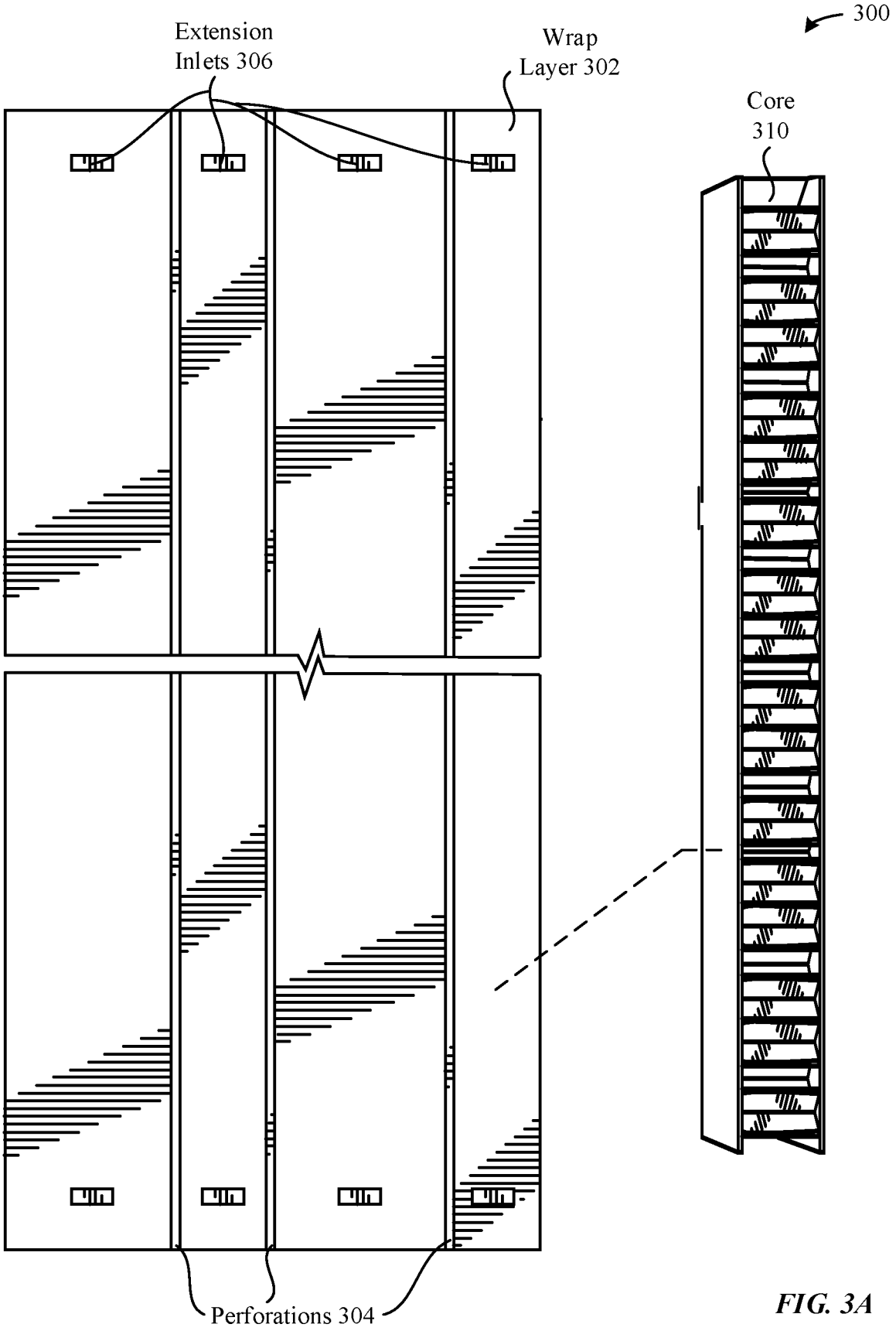
FIGS. 3A-3C illustrate conceptual diagrams of a third approach for implementing a concrete form apparatus, according to some embodiments.
Figure 3B:
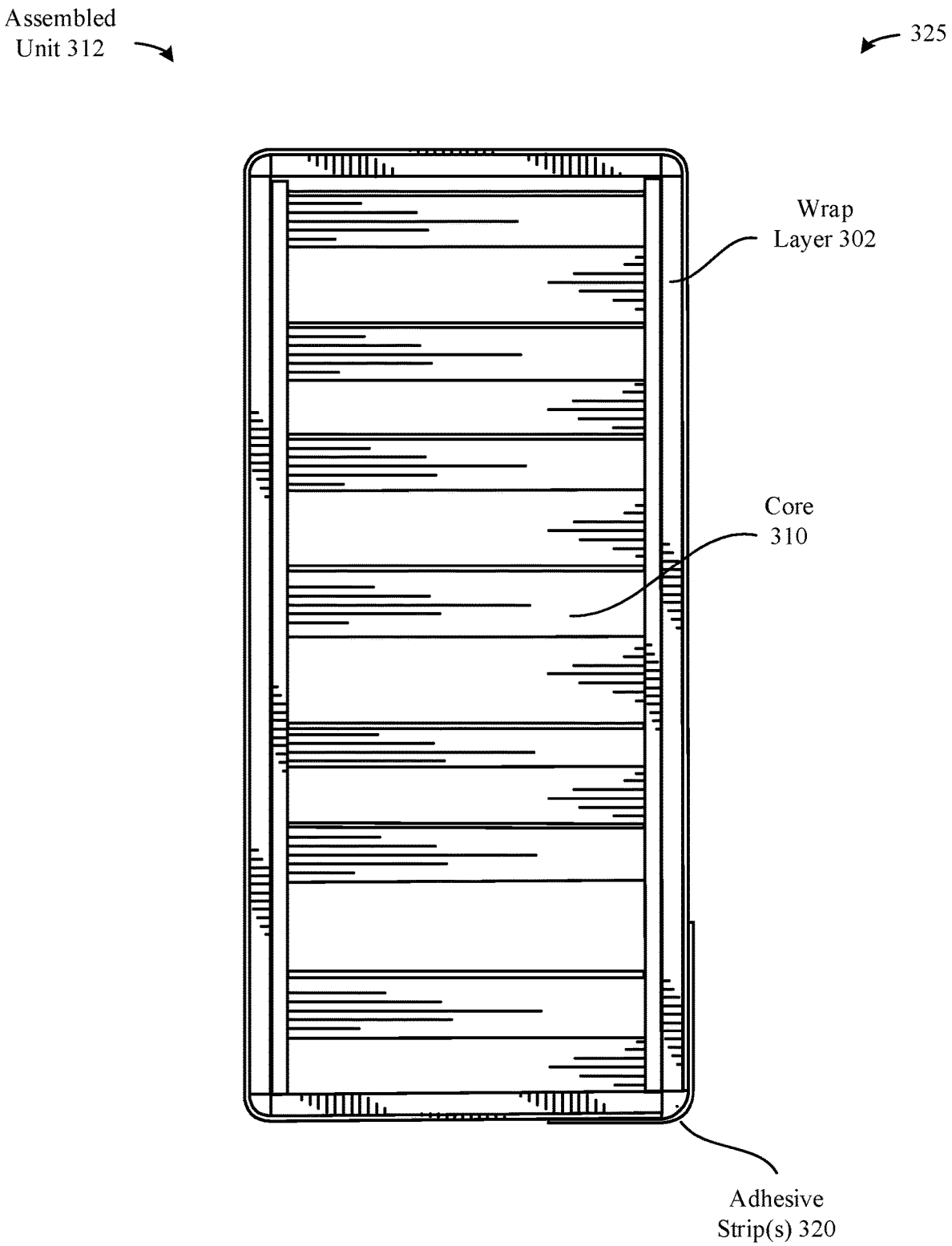
Figure 3C:
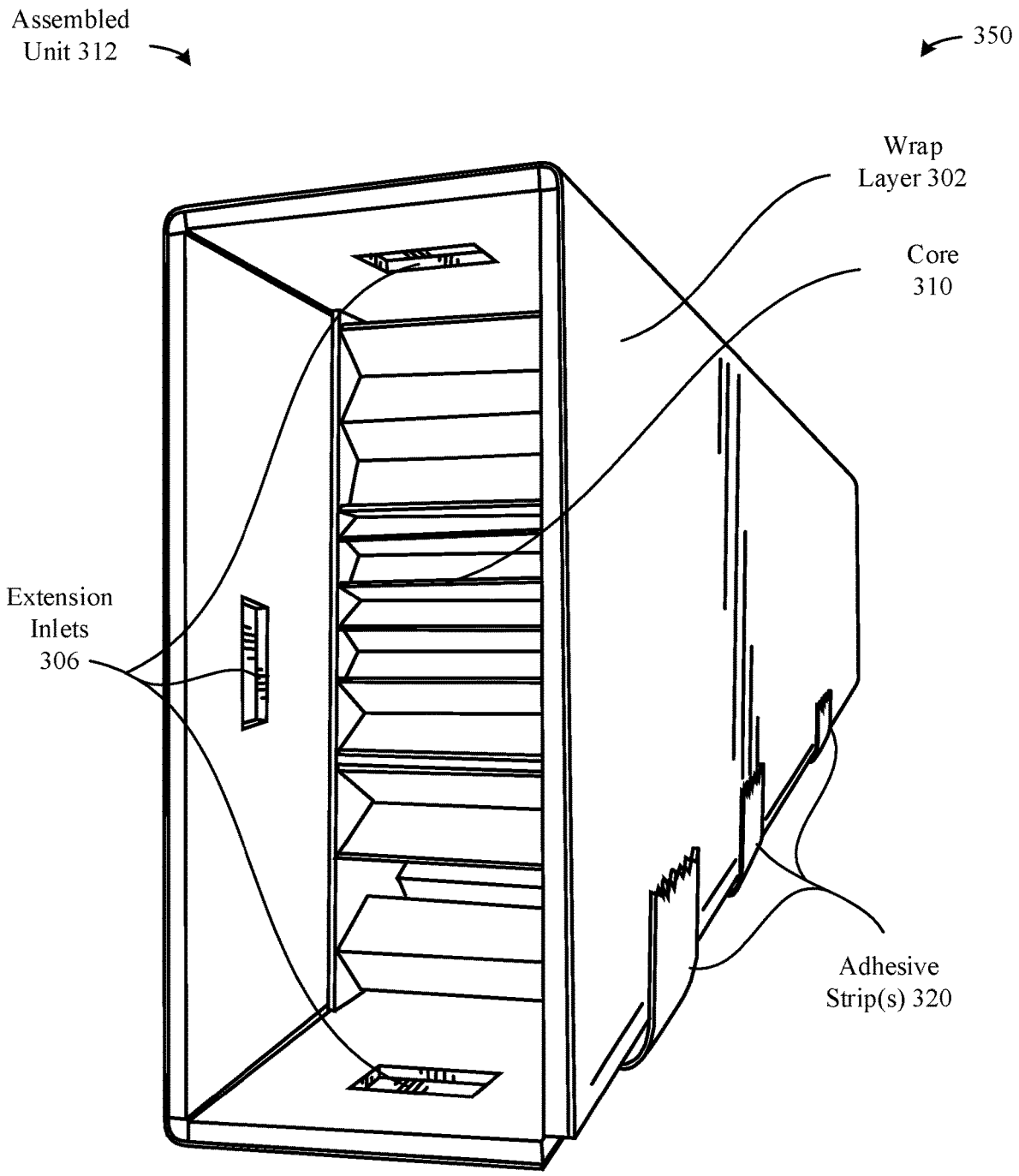

Accordingly, FIGS. 2A-2C illustrate conceptual diagrams of a second approach for implementing a concrete form apparatus, according to some embodiments. FIGS. 3A-3C—which set forth a third approach for implementing a concrete form apparatus—will now be discussed below in greater detail.

FIG. 3A illustrates a conceptual diagram 300 of a high-level overview of two different components that can be utilized to establish a concrete form apparatus, which, as shown, can include a wrap layer 302 and a core 310. According to some embodiments, the wrap layer 302 can be composed in the same manner as the wrap layer 102 of FIG. 1A. However, a notable difference is that the wrap layer 302 is shorter in width (relative to both the wrap layer 102 of FIG. 1A and the wrap layer 202 of FIG. 2B) and includes different perforations 304 (relative to the wrap layer 102 of FIG. 1A and the wrap layer 202 of FIG. 2B). However, there are only three perforations 304 in the wrap layer 302, such that when the wrap layer 302 is folded into a rectangular shape, no edges of the wrap layer 302 overlap one another. This notion is illustrated in FIG. 3B. One benefit of this approach is that less material is needed to manufacture the concrete form apparatus and one less perforation is required, thus reducing manufacturing costs. However, since there are no overlapping sections when the wrap layer 302 is folded, the overall rigidity is reduced, thus constituting a tradeoff between cost and strength.

Additionally, as shown in FIG. 3A, the wrap layer 302 can include several extension inlets 306 that enable an extension apparatus to bind two or more of the concrete form apparatuses together. According to some embodiments, the extension inlets 306 can represent cavities within the wrap layer 302 that align with extension outlets on the extension apparatus when the concrete form apparatus is in a completed state, which is illustrated in FIG. 3C and described below in greater detail. Again, it is noted that such extension inlets 306 are optional and can be omitted from the wrap layer 302.

Additionally, as shown in FIG. 3A, the concrete form apparatus can include a core 310 that is sized in accordance with the wrap layer 302, the perforations 304, and the extension inlets 306. The core 310 can be composed in the same manner as the core 110 of FIG. 1A. As previously described herein, the core 310 can be sized in accordance with the cavity that is formed when the wrap layer 302 is folded along the perforations 304. In this regard, when the extension inlets 306 are not included in the wrap layer 302, the length of the core 310 can match the length of the wrap layer 302. Alternatively, when the extension inlets 306 are included in the wrap layer 302, the length of the core 310 can be shorter (relative to the length of the wrap layer 302) so that the extension inlets 306 remain exposed within the concrete form apparatus. This notion is illustrated in FIG. 3C, which is described below in greater detail.

In any case, the core 310 can be placed onto the wrap layer 302—e.g., centered along the lengthwise dimension of the wrap layer 302—such that the wrap layer 302 can be folded around the core 310 to establish an assembled unit 312, which is illustrated in FIGS. 3B-3C and described below in greater detail.

As shown in the conceptual diagram 325 of FIG. 3B, the core 310 can be wrapped within the wrap layer 302 as it is folded along the perforations 304. Again, although not explicitly illustrated in FIGS. 3A-3B, it is noted that any form of adhesive can be applied to any portion of the wrap layer 302 and/or core 310 without departing from the scope of this disclosure. For example, an adhesive layer can be applied to one or more sides of the core 310, an adhesive layer can be applied to one or more of the (internal) sides of the wrap layer 302 that contact the core 310, and so on. Additionally, it is noted that one or more adhesive strips 320 can be applied to the edges of the wrap layer 302 that meet when it is folded along the perforations 304 into the rectangular shape depicted in FIG. 3B. According to some embodiments, one or more adhesive strips 320 can run perpendicular to the edge that is formed between the edges of the wrap layer 302 that meet (as depicted in FIG. 3C). Alternatively, one or more adhesive strips 320 can run parallel to the aforementioned edge that is formed. This approach can provide the advantage of reducing the permeability of the concrete form apparatus given the edge might otherwise expose the core 310 to moisture. In this regard, the wrap layer 302, the core 310, and the adhesive layer(s) can work together to form an assembled unit 312 that exhibits a level of rigidity that is commensurate for functioning as a concrete form.

Additionally, the conceptual diagram 350 in FIG. 3C illustrates another view of the assembled unit 312. In particular, the conceptual diagram 350 covers a scenario in which the extension inlets 306 are included in the wrap layer 302, and where the length of the core 310 is shorter (relative to the length of the wrap layer 302) so that the extension inlets 306 remain exposed within the concrete form apparatus. The conceptual diagram 350 also illustrates how one or more adhesive strips 320 can run perpendicular to the aforementioned edge that is formed.

Accordingly, FIGS. 3A-3C illustrate conceptual diagrams of a third approach for implementing a concrete form apparatus, according to some embodiments. It is noted that while FIGS. 1A-1C, 2A-2C, and 3A-3C primarily contemplate a single wrap layer that is folded around a single core, the invention is not so limited. For example, any number of wrap layers can be folded around any number of cores without departing from this disclosure. Additionally, the wrap layers can be perforated in various areas in order to produce additional edges that overlap one another without departing from the scope of this disclosure. Additionally, a given wrap layer can be perforated in a manner that causes it to take a non-rectangular (e.g., square, triangle, etc.) shape when folded along the perforations to increase rigidity. Additionally, it is noted that any materials, substances, etc., can be applied to one or more of the wrap layer, the core, or the concrete form apparatus itself to reduce overall permeability. For example, the exposed side of the wrap layer can be coated in one or more hydrophobic substances. In another example, the concrete form apparatus itself can be wrapped with one or more vinyl layers that renders it waterproof and increases its overall rigidity. In other examples, one or more wax coatings, form release spray, one or more layers of freezer grade coated paper, waterproof tape, one or more water resistance coatings, one or more paint coatings, etc., can be used without departing from the scope of this disclosure.

Additionally, FIGS. 4A-4B—which set forth different approaches that can be used for implementing extension apparatuses—will now be discussed below in greater detail. It is noted that the extension apparatuses described herein can be manufactured using any processes or materials (e.g., plastic, metal, carbon fiber, etc.) without departing from the scope of this disclosure. It is additionally noted that the extension apparatuses can be coated using any of the various substances, materials, sprays, layers, etc. disclosed herein without departing from the scope of this disclosure.

Figure 4A:
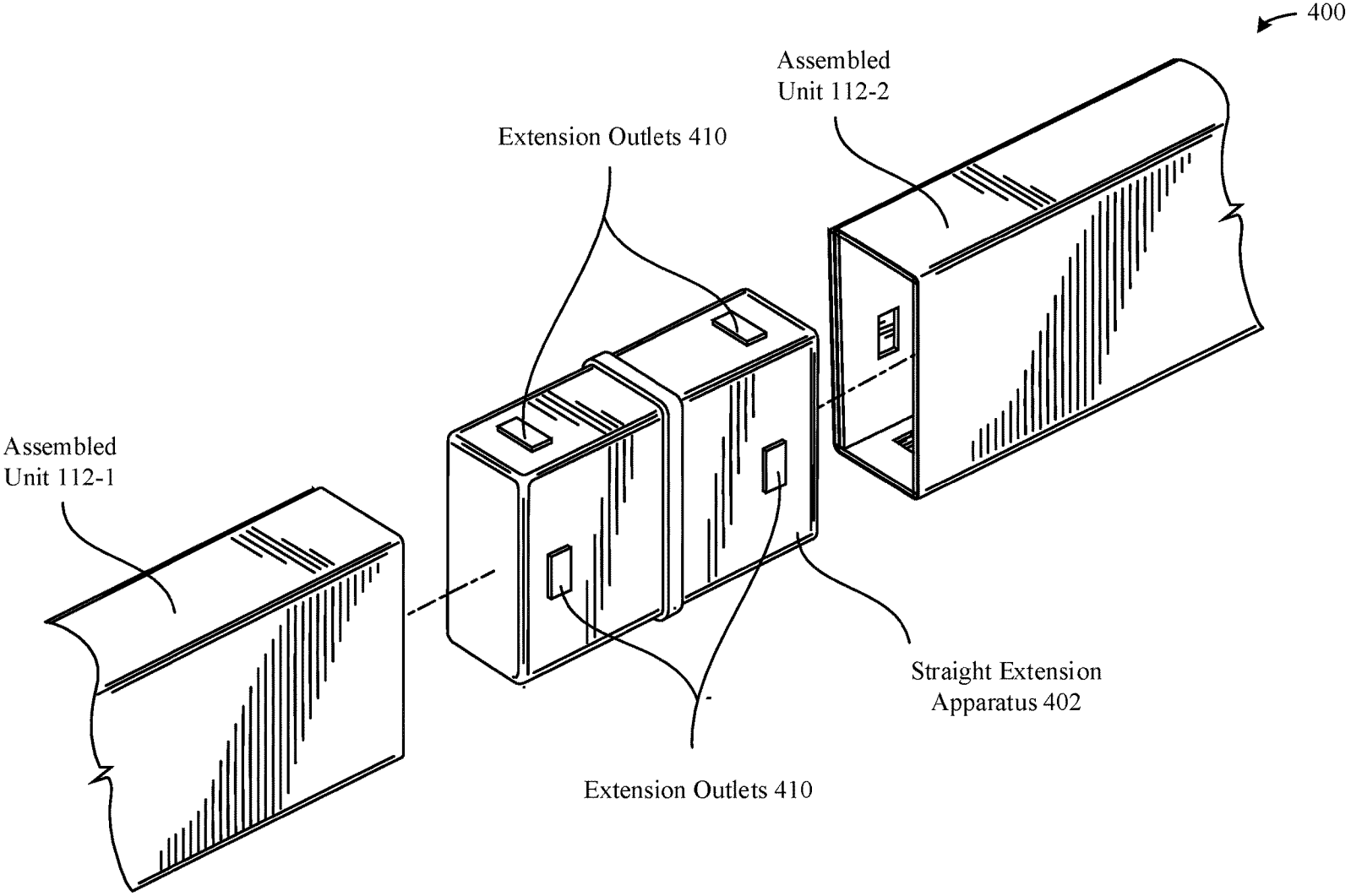
FIGS. 4A-4B illustrate conceptual diagrams of different approaches for implementing extension apparatuses that can be used to bind two or more concrete form apparatuses, according to some embodiments.

FIG. 4A illustrates a conceptual diagram 400 of a first approach for implementing a straight extension apparatus 402, according to some embodiments. As shown in FIG. 4A, the straight extension apparatus 402 can be used to bind two different assembled units 112 together without changing the angle between the assembled units 112. According to some embodiments, the two outer portions of the straight extension apparatus 402 can be sized in accordance with the cavity that is formed within the assembled units 112. Additionally, the straight extension apparatus 402 can include extension outlets 410 that are positioned based on the extension inlets 106 within the assembled units 112 that are designed to accept the straight extension apparatus 402. According to some embodiments, the extension outlets 410 can be fixed in position. In other embodiments, the extension outlets 410 can mechanically raise and lower to increase the ease with which the straight extension apparatus 402 can couple with the assembled units 112.

Additionally, the straight extension apparatus 402 can also include a raised "ring" section (rotating about the middle of the straight extension apparatus 402) having a height that is sized in accordance with the thickness of the wrap layers 102 used to form the assembled units 112. In this regard, when the outer portions of the straight extension apparatus 402 are inserted into the cavities of the assembled units 112-1 and 112-2, there is a smooth transition between the assembled unit 112-1, the straight extension apparatus 402, and the assembled unit 112-2. This can be beneficial as it mitigates any potential unevenness in the perimeter structure that might otherwise cause imperfections in the concrete as it cures.

Figure 4B:
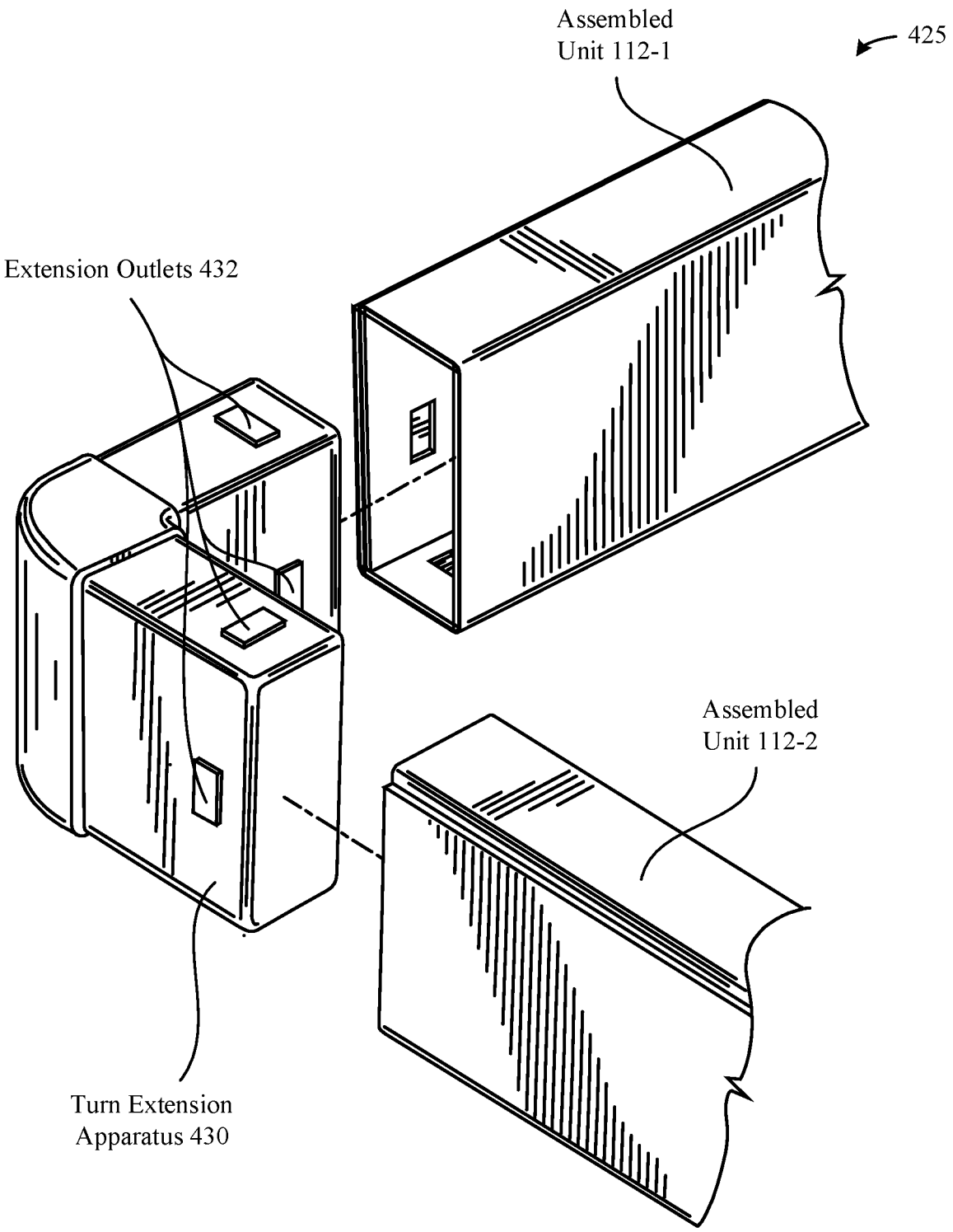

Additionally, FIG. 4B illustrates a conceptual diagram 425 of a second approach for implementing a turn extension apparatus 430, according to some embodiments. As shown in FIG. 4B, the turn extension apparatus 430 can be used to bind two different assembled units 112 together while changing the angle between the assembled units 112 by ninety degrees. As with the straight extension apparatus 402, the outer portions of the turn extension apparatus 430 can be sized in accordance with the cavity that is formed within the assembled units 112. The turn extension apparatus 430 can also include extension outlets 432 that are positioned based on the extension inlets 106 within the assembled units 112 that are designed to accept the turn extension apparatus 430. The turn extension apparatus 430 can also include a raised "ring" section (rotating about the middle of the turn extension apparatus 430) whose height is sized in accordance with the thickness of the wrap layers 102 used to form the assembled units 112. Again, this enables a smooth transition to take place between the assembled unit 112-1, the turn extension apparatus 430, and the assembled unit 112-2.

Accordingly, FIGS. 4A-4B set forth different approaches that can be used for implementing extension apparatuses. It is noted that these approaches are merely exemplary and are not meant to be limiting in any fashion. For example, the extension apparatuses can be configured to introduce any angle between two different assembled units 112. Moreover, any number of extension apparatus can be used to bind two or more different assembled units 112 together at any number of angles, thereby providing a system in which any perimeter shape—with any number of edges—can be established by utilizing the apparatuses described herein. Additionally, it is noted that that the extension apparatuses are not required to be fixed-angle devices. For example, the turn extension apparatus 430 can incorporate a mechanical device that enables the turn extension apparatus 430 to bind two concrete form apparatuses together while establishing any desired angle between them.

The foregoing description, for purposes of explanation, used specific nomenclature to provide a thorough understanding of the described embodiments. However, it should be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It should be apparent to one of ordinary skill in the art that many modifications and variations are possible in view of the above teachings.

What is claimed is:

1. A concrete form apparatus, comprising:

a first component composed of a cardboard material that is rectangular in shape and includes at least three perforations along a lengthwise dimension of the cardboard material; and a second component composed of a core material having dimensions sized to fit within an internal cavity that is formed when the cardboard material is folded along the at least three perforations, wherein the second component is placed onto the first component, and the first component is folded along the at least three perforations to encapsulate the second component within the internal cavity to provide the concrete form apparatus, wherein the first component includes an inner surface facing the internal cavity, the inner surface defines at least one extension inlet, each extension inlet of the at least one extension inlet being a cavity extending away from the internal cavity and perpendicular to a surrounding area of the inner surface, and each extension inlet of the at least one extension inlet is configured to receive and engage a corresponding extension outlet of a coupling apparatus for connecting the concrete form apparatus to another concrete form apparatus.

2. The concrete form apparatus of claim 1, wherein the cardboard material is composed of paperboard, fiberboard, matboard, or chipboard.

3. The concrete form apparatus of claim 1, wherein the cardboard material comprises a single face board, a single wall board, a double wall board, or triple wall board.

4. The concrete form apparatus of claim 1, wherein the cardboard material is formed in accordance with a C, B, E, F, or R flute structure, or a honeycomb structure.

5. The concrete form apparatus of claim 1, wherein the core material is composed of cardboard, paperboard, fiberboard, matboard, or chipboard.

6. The concrete form apparatus of claim 5, wherein the core material comprises a single face board, a single wall board, a double wall board, or triple wall board.

7. The concrete form apparatus of claim 5, wherein the core material is formed by layering any of the cardboard, paperboard, fiberboard, matboard, or chipboard together.

8. The concrete form apparatus of claim 1, wherein the core material is formed in accordance with a C, B, E, F, or R flute structure, or a honeycomb structure.

9. The concrete form apparatus of claim 1, wherein the core material is composed of foam in part or in whole.

10. The concrete form apparatus of claim 1, wherein the at least three perforations are formed by establishing holes or slices along the lengthwise dimension of the cardboard material.

11. The concrete form apparatus of claim 1, wherein the at least three perforations comprise three perforations, and an adhesive is applied to seal two edges of the cardboard material that meet when the cardboard material is folded along the three perforations.

12. The concrete form apparatus of claim 1, wherein the at least three perforations comprise four perforations such that when the cardboard material is folded along the four perforations, two sections of the cardboard material overlap one another.

13. The concrete form apparatus of claim 12, wherein an adhesive is applied to at least one of the two sections of the cardboard material that overlap one another.

14. The concrete form apparatus of claim 12, wherein the two sections of the cardboard material overlap one another along a height dimension or a length dimension.

15. The concrete form apparatus of claim 1, wherein the cardboard material and/or the core material are coated with one or more hydrophobic substances, one or more vinyl layers, one or more wax coatings, form release spray, one or more layers of freezer grade coated paper, waterproof tape, one or more water resistance coatings, or one or more paint coatings.

16. The concrete form apparatus of claim 1, wherein:

a second concrete form apparatus includes at least one second extension inlet, and wherein the coupling apparatus enables the concrete form apparatus and the second concrete form apparatus to be bound together by way of the at least one extension inlet and the at least one second extension inlet, respectively.

17. The concrete form apparatus of claim 16, wherein the at least one extension inlet and the at least one second extension inlet included in each of the concrete form apparatus and the second concrete form apparatus, respectively, are sized to receive extension outlets included on the coupling apparatus.

18. The concrete form apparatus of claim 16, wherein the coupling apparatus enables the second concrete form apparatus to extend the concrete form apparatus at a non-zero angle relative to the concrete form apparatus.

19. The concrete form apparatus of claim 16, wherein the coupling apparatus includes a raised ring section having a height that is sized in accordance with a thickness of the cardboard material.

20. The concrete form apparatus of claim 16, wherein the coupling apparatus enables the second concrete form apparatus to extend the concrete form apparatus in a straight line relative to the concrete form apparatus.

* * * * *